US008823599B2

(12) United States Patent
Shtatnov et al.

(10) Patent No.: US 8,823,599 B2
(45) Date of Patent: Sep. 2, 2014

(54) LOW-PROFILE TUNABLE WIDE-RANGE LOOP-SLOT ANTENNA

(76) Inventors: Artem Shtatnov, Newtown, PA (US); Aleksandr Gromov, Freehold, NJ (US)

( * ) Notice: Subject to any disclaimer, the term of this patent is extended or adjusted under 35 U.S.C. 154(b) by 352 days.

(21) Appl. No.: 12/870,839

(22) Filed: Aug. 29, 2010

(65) Prior Publication Data

US 2011/0050536 A1 Mar. 3, 2011

Related U.S. Application Data

(60) Provisional application No. 61/238,191, filed on Aug. 30, 2009.

(51) Int. Cl.
*H01Q 7/00* (2006.01)
*H01Q 13/10* (2006.01)

(52) U.S. Cl.
CPC ..... *H01Q 7/005* (2013.01); *H01Q 13/103* (2013.01)
USPC ..... 343/870; 343/846; 343/700 MS

(58) Field of Classification Search
USPC ..... 343/700 MS, 702, 828, 826, 846
See application file for complete search history.

(56) References Cited

U.S. PATENT DOCUMENTS 5,767,813 A * 6/1998 Verma et al. ..... 343/744
6,545,640 B1 * 4/2003 Herve et al. ..... 343/700 MS

* cited by examiner

*Primary Examiner* — Don Le

(57) ABSTRACT

The Loop-Slot Antenna design provides a large range of tunable frequencies for transceiving while maintaining a small profile perfect for mounting on vehicles or other objects where a large antenna is impractical or infeasible. As compared with known vertical polarization antennas that have considerable height, for instance quarter-wave and half-wave vertical stubs of h=λ/4 or h=λ/2, the antenna of this invention has height of h=λ/100.

4 Claims, 1 Drawing Sheet

LOW-PROFILE TUNABLE WIDE-RANGE LOOP-SLOT ANTENNA

BACKGROUND OF THE INVENTION

The main goal of this design is to improve the ability to transmit and receive over a wide range of frequencies while still maintaining a low profile on the antenna. At the same time, this design can be used with standard feeders. The present invention belongs to antennas that transmit and receive electromagnetic oscillations with vertical polarization in the SW and USW bands and, more specifically, to antennas with low electric and geometric height.

Resonant Vertical Antennas

Resonant vertical antennas with height $h \leq 0.1 \cdot \lambda$ electrically shorted with additional inductivity or capacity are widely used in practice. Antenna with additional inductivity provide quasi-sinusoidal current distribution along its length and the radiation resistance $R_S$ is defined as:

$$R_S = 20 \cdot \pi^2 \left(\frac{h}{\lambda}\right)^2,$$

where $\lambda$ is wavelength of the operating frequency. Thus, creating a vertical antenna with height $$\frac{h}{\lambda} = 0.01$$

is not feasible because it has very low radiation resistance $R_S = 2 \cdot 10^{-2}$ Ом and antenna efficiency of about zero.

Insertion of a capacity load into the upper part of the vertical antenna provides considerable increase in the current at the top of emitter and, in theory, can provide uniform current distribution along its length. With this alteration the radiation resistance is $$R_S = 80 \cdot \pi^2 \cdot \left(\frac{h}{\lambda}\right)^2.$$

Further, the radiation resistance increases by a factor of four and for antenna with $$\frac{h}{\lambda} = 0.01$$

becomes $R_S = 8 \cdot 10^{-2}$ Ом. Though higher, that is also unacceptable for practical application. Moreover, these vertical antenna designs must have complicated elements to modify parameters of additional inductivity and a capacitor to provide frequency tuning.

Slot Antennas

Slot antennas are widely used for microwave frequencies. They have a comparatively large input resistance $R_E = 500 \sim 1000$ Ohm and hence high radiation resistance under efficiency $\eta = 0.7 \sim 0.9$. Inventor A. D. Blumlein received one of the first patents on the slot antenna design in 1938 (British Patent No 515684). A slot antenna is a narrow slot in a metallic plate. That slot has small height a in comparison to length 2l, equal to $$2 \cdot l = v \cdot \frac{\lambda}{2},$$

where v is the contraction factor that depends on the permittivity $\in$ of the medium in the slot and ratio of slot height a and length.

$$v = f\left(\varepsilon, \frac{a}{2l}\right).$$

Generally slot length is about $\lambda/2$ for air dielectric when $\in \approx 1$. Properties of slot radiation are the same as for a half-wave oscillator, yet there is an inverse distribution of magnetic and electric components in the field intensity.

In the case when slot antenna has dimensions $0.1 \cdot \lambda \leq 2 \cdot l < 0.5 \cdot \lambda$ then the intrinsic impedance $Z_s$ of the slot at the middle of the curtain can be approximately estimated via parameters of an equivalent oscillator:

$$Z_s = \frac{2(60 \cdot \pi)^2}{Z_d},$$

where $Z_d = R_d + j \cdot X_d$ is impedance of the equivalent oscillator. The active component of input impedance of the equivalent oscillator depends considerably on the slot size 2l:

$$R_d = \rho_d \frac{sh(2kl) - (\gamma/k) \cdot \sin(2kk_1 l)}{sh(2kl) - \cos(2kk_1 l)}, \text{ where } k = \frac{2\pi}{\lambda}$$

is a wavenumber; $k_1$ is correction factor that takes into consideration influence of slot geometry on antenna contraction factor, $$\gamma = \frac{R_s}{\rho_d \cdot l \cdot \left[1 - \frac{\sin(2kk_1 l)}{2kk_1 l}\right]}; \; R_s = 80\pi^2 \left(\frac{l}{\lambda}\right)^2$$

is radiation resistance of the equivalent oscillator to the current loop;

$$\rho_d = 120\left[\ln\left(\frac{2l}{r}\right) - 1\right]$$

is oscillator impedance;

$$r = \frac{a}{4}$$

is equivalent oscillator radius; and a is the slot height.

The reactive component of the equivalent oscillator resistance is:

$$X_d = -j\rho_d \frac{\sin(2kk_1 l) + \left(\frac{\gamma}{k}\right) \cdot sh(2kl)}{ch(2kl) - \cos(2kk_1 l)}.$$

During this calculation it must be taken into account that the calculated reactive resistance of the equivalent oscillator is equal by value, yet of the opposite sign relative to the reactive component of input resistance of a non-resonant slot antenna. For instance, if the equivalent oscillator has a capacitive component of input resistance, then the equivalent slot antenna has an inductive component of input impedance. In other words, voltage distribution along the slot antenna corresponds as a first approximation to voltage distribution in line with shorted end so that input resistance at clamps on the middle of the long side of the slot antenna is of inductive nature.

For this reason, the resonant slot antennas with size $$2l = v\frac{\lambda}{2}$$

have some considerable disadvantages. First, they are narrow-band, therefore the tuning ratio is $$k_f = \frac{f_{max}}{f_{min}} \leq 1.1,$$

where $f_{max}$ is the maximum operation frequency and $f_{min}$ is minimum operation frequency. Second, the uncompensated reactive component of input resistance is always present in the operation band. Finally, to excite a slot antenna at its center, it is necessary to apply a high-resistant feeder with non-standard impedance.

DETAILED DESCRIPTION OF THE INVENTION

Figure 1:
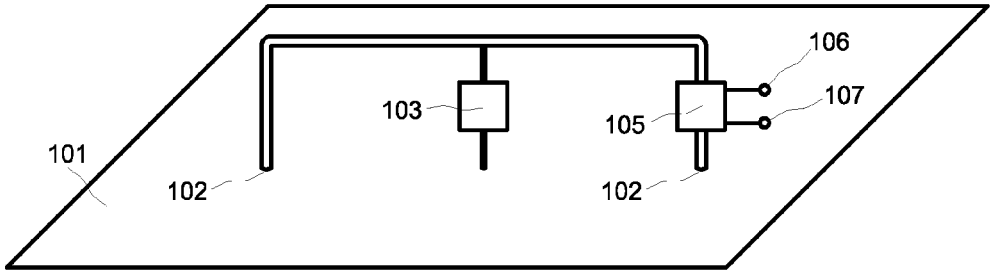
FIG. 1 is of the Loop-Slot Antenna in a perspective view showing all the major parts of the antenna. The drawing is not to scale and only shows a general construction of the antenna. The antenna is comprised mainly of the base 101 and curtain 104 attached to the base at 90 degree angles at points 102. The addition of a variable capacitor 103 and transformer 105 are also shown to provide the most effective performance, yet they are not necessary. The transformer is connected to a feeder 107 and a ground 106.
Figure 2:
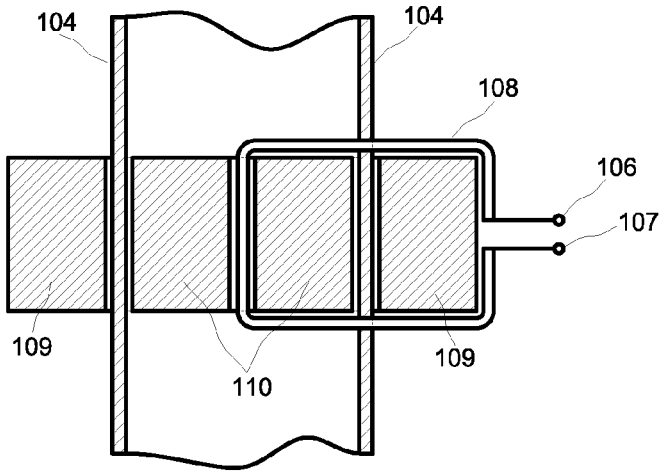
FIG. 2 is a cross sectional view of the transformer 105 attached to one of the vertical legs of the curtain 104. The transformer is comprised of three concentric rings—the two ferrite rings and the curtain leg. The inside ferrite ring 110 is within the diamagnetic tube of the vertical curtain leg 104. The outside ferrite ring 109 surrounds the curtain leg 104. The primary winding 108 of the transformer loops through the two ferrite rings and is connected to a feeder 107 and ground 106. The drawing is not to scale.

The present invention relates mainly to antennas that are used in short and ultra short wave ranges yet can achieve longer wavelengths with increased size. The antenna can be used for both transmission and reception, yet improved transmission from a small antenna with a wide range of transmission frequencies is the novelty of this design.

The invention provides radiation, transmission, and reception of electromagnetic oscillations with vertical polarization. As compared with known vertical polarization antennas that have considerable height, for instance quarter-wave and half-wave vertical stubs of h=λ/4 or h=λ/2, the antenna of this invention has height of h=λ/100. As shown by multiple tests in a wide frequency range, this antenna design is as effective as a standard vertical polarization antenna.

The Loop-Slot Antenna performs transceiving operations and can be installed on mobile objects, for instance, surface transport, water transport, air and aerospace objects. The small size offers easy concealment for military or defense purposes.

Antenna Design

The Loop-Slot Antenna includes a metallic curtain 104 on a metal base 101. The curtain has a one long side connecting the two shorter parallel sides which are mechanically and electrically fixed 102 on the metal base 101. The curtain, forming together with a variable tuning capacitor 103 a half-wave non-symmetric line, is short-circuited on the metallic base by two opposite short sides 102. One of these short sides is connected to a signal source (feeder) 107 and a ground wire 106.

The curtain 104 may have a long side of one tenth of working wave length connected to short parallel sides with height of one hundredth of maximal working wave length.

The antenna can be connected directly to an amplifier as the signal source, yet is most effective when used with a transformer 105 positioned along one of the short sides of the curtain 104. The transformer 105 is an essential component of the antenna to provide maximal effectiveness.

The metallic base 101 and curtain 104 can both be made of a diamagnetic material with high electrical conductivity. The metallic curtain 104 works best when made from a hollow tube for improved oscillation and reduced weight yet can be made from a solid construction if necessary.

By changing the configuration of the Loop-Slot Antenna, such as changing the shape or position of various components, it is possible to form a desired diagram of radiating direction in a horizontal plane. This can be used to orient it along an object to create an especially heightened strength of electrical and magnetic field of oscillations directly near, under, or above the object.

Mechanical configurations of the Loop-Slot Antenna include, yet are not limited to, the size of the antenna or any subpart of the antenna, the position of the curtain 104 on the base 101, the shape of the curtain 104, the angle the curtain 104 forms with the base 101, the size of the curtain 104, the size of the base 101, the position of the capacitor 103, the position of the transformer 105, the orientation of the antenna, and the position of the curtain 104 on the base 101 with respect to multiple other curtains present in the same antenna. Other curtains can exist on the antenna to provide a larger range of frequencies covered. Additional configuration by placement of this antenna among a system of antennas is also possible to achieve the most effective signal coverage area.

The variable capacitor 103 may be positioned anywhere along the metallic curtain 104 with greatest effect arising from a connection between the middle of the long side of the curtain and the metallic base 101. The variable capacitor is not required for operation of the antenna. The purpose is to tune the antenna to a wide range of frequencies during operation or to tune the antenna to a specific fixed frequency during manufacture. By using the capacitor 103, one antenna can have a wide range of frequencies without changes to the antenna's geometric dimensions.

This antenna design stems from positive aspects of both the slot antenna and the loop antenna to provide a novel design that is significantly more effective than either of the two older antennas. The loop is formed by the electrical connection of the metallic curtain 104 and the base 101. The slot of a regular slot antenna would normally be positioned as a hole cut in the base. With this design, the theoretical slot hole is instead rotated vertically 90 degrees away from the base and is formed by the curtain.

Transformer

If a slot antenna is fed at the middle of the long side of the curtain 104 then its input resistance is high $R_E$=500~1000 Ohm, yet such a feeding option is not optimal due to construction and technological difficulties during high-resistance symmetrical feeder manufacturing. A better solution is to offset the feeders to one side.

Matching a coaxial or symmetrical two-wire feeder with a Loop-Slot Antenna option only provides a narrow band with $k_f \leq 1.1 \sim 1.2$. For other frequencies, the active and reactive resistance of a feeder connected at an offset position along the curtain will be transformed to the middle of the curtain where a tuning capacitor is connected. The transformed feeder reactivity lowers the tuning range of antenna. Thus the matcher must be offset from the tuning capacitor operating zone. This requirement is realized when a HF transformer 105 is used in the Loop-Slot Antenna on one of vertical legs.

This method of transformer connection removes the influence of feeder matching circuits on the antenna tuning range. Here, the feeder is connected to the transformer's primary winding. The transformer's secondary winding is a section of circular tube placed between two ferrite rings. For optimal performance, the transformer should be designed as follows. The primary winding 108 is attached to the feeder 107 and a ground 106. A diamagnetic tube 104, being one of the legs of the curtain in this case, is placed between the outside ferrite ring 109 and the inside ferrite ring 110. The inside ferrite ring 110 is located inside the tube 104. The section of diamagnetic tube 104 between rings 109 and 110 acts the part of transformer secondary winding. The primary winding encompasses ferrite rings 109 and 110. When HF voltage is applied to the feeder, current runs in winds 108 and creates magnetic flux in ferrite rings 109 and 110. The secondary winding 104 encompasses rings 109 and 110 therefore alternating magnetic field with intensity H induces an EMF in the curtain 104.

The transformer has a few distinctive features. First, the secondary winding of the HF transformer is an inseparable and irreplaceable part of the Loop-Slot Antenna's structure. Second, by changing the number of ferrite rings fitted on the tube and inserted into the tube, it is possible to control the output resistance of the transformer in the range from 0.3~3 Ohm providing the matching of input resistance, as in low-resistant antennas, with the impedance of standard feeders. Finally, the secondary winding, the metallic tube, must be of a diamagnetic material to allow magnetic field lines from the ferrite rings to pass easily through the tube producing a HF current on the outside of the tube. This is possible only for diamagnetic materials that have absolute magnetic conductivity $\mu_a$ equal to the conductivity of free space: $\mu_a=\mu\cdot\mu_0=4\pi\cdot10^{-7}$ H/m, where $\mu_0=4\pi\cdot10^{-7}$H/m is free space absolute magnetic conductivity; $\mu=1$ is relative magnetic conductivity of diamagnetic materials.

What is claimed is:

1. An antenna comprising a conductive curtain mounted vertically on a conductive surface base where a transformer is mounted on the curtain to provide a means of delivering the signal.

2. The utility of claim 1 where a capacitor is mounted between the curtain and the base to provide tuning capabilities.

3. The utility of claim 1 where multiple curtains exist on the same base.

4. The utility of claim 2 where multiple curtains exist on the same base.

* * * * *